US005845855A

United States Patent [19]

Yamada et al.

[11] Patent Number: 5,845,855

[45] Date of Patent: Dec. 8, 1998

[54] MECHANICAL GRINDING APPARATUS

[75] Inventors: Yukiyoshi Yamada; Satoshi Akiyama; Takahiro Ichikawa, all of Saitama; Hideo Okabe, Osaka, all of Japan

[73] Assignee: Nisshin Flour Milling Co., Ltd., Tokyo, Japan

[21] Appl. No.: 746,836

[22] Filed: Nov. 18, 1996

[30] Foreign Application Priority Data

Nov. 24, 1995 [JP] Japan ..... 7-305554

[51] Int. Cl.[6] ..... B02C 19/00

[52] U.S. Cl. ..... 241/57; 241/260

[58] Field of Search ..... 241/260, 261.1, 241/261, 57

[56] References Cited

U.S. PATENT DOCUMENTS

| | | | |
|---|---|---|---|
| 27,246 | 2/1860 | Sweet | 241/261.1 |
| 3,305,183 | 2/1967 | Morden | 241/261.1 |
| 3,806,050 | 4/1974 | Cumpston, Jr. . | |
| 5,269,471 | 12/1993 | Yamagishi . | |

FOREIGN PATENT DOCUMENTS

| | | |
|---|---|---|
| 0 122 608 A2 | 10/1984 | European Pat. Off. . |
| 1118720 | 6/1956 | France . |
| 59-105853A | 12/1982 | Japan . |
| 3-15489B | 3/1991 | Japan . |
| 07155628A | 6/1995 | Japan . |
| 1043945 | 6/1956 | United Kingdom . |

*Primary Examiner*—Mark Rosenbaum
*Attorney, Agent, or Firm*—Weiser and Associates, P.C.

[57] ABSTRACT

A mechanical grinding apparatus of the present invention, which includes a rotor supported by a rotary shaft and having a plurality of grooves defined on the outer peripheral surface thereof and a liner inserted to the outside of the rotor so as to form a desired gap between the liner and the rotor and having a plurality of grooves defined on the inner peripheral surface thereof for grinding a substance to be ground in the gap, is characterized in that the grooves of at least one of the rotor and the liner incline in a direction preventing the flow of the substance to be ground with respect to a direction parallel with a rotary shaft. Since the mechanical grinding apparatus of the present invention can make a ground substance having a small particle size, no large particles mixed therein and a sharp particle size distribution width at a high efficiency, the grinding apparatus is preferably applicable to powder composed of resin or mainly composed of resin to be finely ground.

19 Claims, 13 Drawing Sheets

MECHANICAL GRINDING APPARATUS

BACKGROUND OF THE INVENTION

1. Field of the Invention

The present invention relates to a mechanical grinding apparatus suitable to dry grinding process in the production of powder composed of resin or mainly composed of resin and, in particular, in the production of dry toner and powder paint.

Dry mechanical grinding or pulverizing process is executed in the production of dry toner, powder paint and the like to regulate the particle size of a final product and the particle size distribution thereof and various mechanical grinding apparatus such as crushers, mills, grinders and pulverizers to be used for the process have been proposed.

2. Description of the Prior Art

Conventionally, there are known fine grinders and fine pulverizers disclosed in Japanese Patent Application Laid-Open No. 59-105853 and Japanese Patent Publication No. 3-15489 as a rotary mechanical grinding apparatus for finely grinding a feed substance to be ground (hereunder referred simply to as "feed substance"). As shown in FIG. 13, a fine grinder 50 is arranged such that a rotary shaft 56 supports a cylindrical rotor 54 having a multiplicity of concave/convex portions 52 defined on the outer peripheral surface thereof in parallel with a generating line and continuous in a peripheral direction, a cylindrical liner 62, which has a plurality of concave/convex portions 60 defined on the inner peripheral surface thereof in parallel with the generating line and continuous in a peripheral direction, is inserted outside of the rotor 54 with a fine gap 58 defined between the outer peripheral surface of the rotor 54 and the inner peripheral surface of the liner 62 and the fine gap 58 is used as a grinding chamber.

In the fine grinder 50, the rotor 54 is rotated at high speed and the feed substance supplied from a feed substance supply port 66 disposed at the lower left portion of a casing 51 in the drawing is forcibly fed into the grinding chamber composed of the fine gap 58 together with a flow of air which is sucked from a product discharge port 64 disposed at the upper right side of the casing 51 in the drawing by a suction blower (not shown) or the like. At the time, the feed substance is ground and made to fine powder by being effectively caused to collide against the concave/convex surfaces of the rotor 54 and the liner 62 by the swirls produced by the concave/convex surfaces or ground by being subjected to shear force caused by friction between both the convexities of the rotor 54 and the liner 62. Thereafter, the fine powder flown out from the fine gap is discharged to the outside of the apparatus through the product discharge port. Note, this type of the fine grinder 50 is equipped with a classifying ring 68 disposed at the upper end of the liner 62 to close the concavities of the concave/convex portions 60 of the liner 62 in order to prevent the flow-out of large particles from the gap 58 and permit the flow-out of only fine particles.

In the fine grinder 50, when an interval of the fine gap 58 constituting the grinding chamber is set to 1 mm or less and the rotor 54 is rotated at high speed, the feed substance is effectively ground to fine powder in such a manner that the feed substance is caused to collide against each other by the swirls constantly produced from both the concave/convex surfaces of the liner 62 and the rotor 54 into the concavities thereof and subjected to shearing force. As a result, a ground substance is obtained which is within a relatively narrow particle size distribution width ranging from an order of microns to an order of several tens of microns.

In the fine grinder 50, there are proposed combinations of the concave/convex portions 52 of the rotor 54 and the concave/convex portions 60 of the liner 62 as shown in FIGS. 14*a*, 14*b*, 14*c* and 14*d*. In these drawings, although concave/convex portions 52*a* and concave/convex portions 60*a* have a square lateral cross sectional shape and concave/convex portions 52*b* and concave/convex portions 60*b* have a triangular lateral cross sectional shape, it is known that an excellent grinding performance can be obtained by the combination of the triangular concave/convex portions 52*b* and the triangular concave/convex portions 60*b* shown in FIG. 14*d* among the above combinations.

Japanese Patent Publication Laid-Open No. 7-155628 proposes mechanical grinding apparatuses 70 and 71, as shown in FIGS. 15*a* and 15*b*, respectively, which are arranged such that (a) a multiplicity of concave/convex portions 72 and (b) a multiplicity of concave/convex portions 72 and 74 in a direction perpendicular to a generating line are continuously defined toward the generating line direction (1) an the outer peripheral surface of a rotor 54 and (2) on both the outer peripheral surface of a rotor 54 and the inner peripheral surface of a liner (cylindrical body) 62 in the direction of the generating line, respectively in addition to a multiplicity of concave/convex portions defined on the outer peripheral surface of the rotor 54 and an the inner peripheral surface of the liner 62 in parallel with the generating line likewise those defined in the aforesaid fine grinder 50.

These mechanical grinding apparatuses 70 and 71 can produce swirls in a vertical direction in addition to swirls in a horizontal direction by defining the concave/convex portions in both the directions, that is, the direction parallel with the generating line and the direction perpendicular to the generating line. Thus, the mechanical grinding apparatuses 70, 71 can obtain a ground substance having a particle size of an order of tens of microns as a result of the improvement of a grinding function.

In addition to the aforesaid, there are known rotary mechanical grinding apparatuses such as, for example, grinding apparatus for grinding hard substances such as various minerals, ceramics, soybeans, stones, gravel and the like disclosed in Japanese Patent Publication No. 4-12190 and Japanese Patent Publication No. 4-12191, a fine grinder for obtaining copying carbon and pigment disclosed in Japanese Patent Publication No. 58-14822 and Japanese Patent Publication No. 58-14823, an ultra-fine grinder for obtaining ultra-fine particle of an order of several microns disclosed in Japanese Patent Publication No. 61-36457 and Japanese Patent Publication No. 61-36459, a grinding apparatus disclosed in Japanese Patent Application Laid-Open No. 5-184960, and the like.

In powder composed of resin or mainly composed of resin and, more specifically, in dry toner, powder paint and the like, powder having a smaller particle size and powder having a similar particle size, that is, a sharp particle size distribution width are required aiming at high quality.

However, when a ground substance having a small particle size is to be obtained by the above conventional mechanical grinding apparatuses, since the rotational speed of a rotor must be increased, a problem arises in energy efficiency, bearing hearing life, noise, vibration, an increase of an exhausted air temperature and the like. Further, a problem also arises in that, since there is a limit in the increase of the rotational speed of the rotor, grinding to the target particle size may be impossible.

Although particles excessively finer than a target particle size (with over grinding) are removed by a classifying means and a particle size distribution is regulated to improve the quality of a product in, for example, dry toner, when the rotational speed of a rotor is high, since many particles are ground to a particle size which is excessively smaller than that of a target particle size, there is a problem that unnecessary particles are increased and a yield is lowered.

In the fine grinder 50 disclosed in Japanese Patent Application Laid-Open No. 59-105853 and Japanese Patent Publication No. 3-15489, a mechanism for narrowing the grinding chamber defined between the rotor 54 and the liner 62 is employed to prevent the passage of large particles. For example, an interval of the above gap 58 serving as the grinding chamber is set to 1 mm or less. However, when the grinding chamber is narrowed as described above, there is a possibility of the occurrence of a problem that the temperature of the grinding chamber is excessively increased by friction heat and the like generated in the grinding operation depending upon the amount of raw material supplied and, in particular, when the raw material is supplied in an amount exceeding a processing capability, in addition to the problem that the processing capability is lowered and the processing amount is reduced. In such a case, there arises a problem in that a powder raw material melts and adheres in the interior of the grinding chamber and it becomes difficult or impossible to further continue the grinding of the powder material.

Further, in the mechanical grinding apparatus disclosed in Japanese Patent Application Laid-Open No. 7-155628, since the concave/convex portions 72, 74 perpendicular to the generating line are defined on the outer peripheral surface of the rotor 54 and the inner peripheral surface of the liner 62 in addition to the concave/convex portions defined thereto in parallel with the generating line, the swirls are also produced in the vertical direction by the convexities thereof in addition to the swirls in the horizontal direction. Thus, there is a problem that swirls are excessively produced, particles excessively collide against each other and, in particular, particles excessively collide against the concavities of the rotor 54, powder is excessively ground and an exhausted air temperature is excessively increased.

SUMMARY OF THE INVENTION

An object of the present invention is to provide a mechanical grinding apparatus suitable for finely grinding powder composed of resin or mainly composed of resin, by which the above problems of the prior art can be solved and a ground substance having a small particle size, no large particles mixed therein and a sharp particle size distribution width can be obtained at a high efficiency.

To solve the above problem, the present invention provides a mechanical grinding apparatus including a rotor supported by a rotary shaft and having a plurality of grooves defined on the outer peripheral surface thereof and a liner inserted to the outside of the rotor so as to form a desired gap between the liner and the rotor and having a plurality of grooves defined on the inner peripheral surface thereof for grinding a substance to be ground in the gap, wherein the grooves of at least one of the rotor and the liner incline in a direction preventing the flow of the substance to be ground with respect to a direction parallel with the rotary shaft.

It is preferable here that the liner further includes grooves defined on the inner peripheral surface thereof which incline in a direction opposite to the flow-preventing direction with respect to the direction parallel with the rotary shaft. In addition, it is preferable that the rotor further includes grooves defined on the outer peripheral surface thereof which incline in a direction opposite to the flow-preventing direction with respect to the direction parallel with the rotary shaft. It is preferable that the grooves of at least one of the grooves of the rotor and the grooves of the liner have an inclining angle of from 5° or more to less than 90° with respect to the direction parallel with the rotary shaft.

It is preferable that the grooves of the rotor have both of grooves inclined in a direction for preventing the flow of the grinding substance and grooves inclined in a direction opposite to the direction with respect to a direction parallel with the rotary shaft and the inclined angle of the grooves is 5° or more to 45° or less.

It is preferable that the cross sectional shape of the grooves in a direction perpendicular to the direction of the grooves of the rotor is such that a front side surface is inclined at an angle within the range of 30° in the direction opposite to the rotational direction of the rotor to 30° in the rotational direction of the rotor with respect to a radial direction from the center of the rotor to a direction of a centrifugal force of the rotor and a rear side surface is inclined at an angle within the range 30° to 70° in a direction opposite to the rotational direction of the rotor with respect to a radial direction from the center of the rotor to a centrifugal force.

It is preferable that the grooves of the rotor have grooves inclined in a direction for preventing the flow of the grinding substance and grooves inclined in a direction opposite to the direction with respect to a direction parallel with the rotary axis of the rotor and the inclined angle of the grooves is 5° to 45°.

It is preferable that the cross sectional shape of the grooves in a direction perpendicular to the direction of the grooves of the liner is such that a front side surface is inclined at an angle of the range of 30° to 70° in the rotational direction of the rotor with respect to a central direction of the rotor and a rear side surface is inclined at an angle within the range of 30° in the direction opposite to the rotational direction of the rotor to 30° in the rotation direction of the rotor with respect to a central direction of the rotor.

In the mechanical grinding apparatus of the present invention, a powder raw material is finely ground in a grinding chamber composed of the gap between the rotor and the liner. However, when the grinding apparatus is operated, since air, which is sucked from a product discharge port for discharging a product and flown into the grinding apparatus together with the powder raw material supplied from a material supply port, flows in the generating line direction of the rotor or the liner, that is, in the direction parallel with the rotary shaft of the rotor, the powder raw material entered the gap serving as the grinding chamber between the rotor and the liner is subjected to force in a direction perpendicular to the air flow by the rotation of the rotor and flown in the rotational direction of the rotor.

In the grinding apparatus of the present invention, however, a plurality of grooves inclined in the direction of the rotary shaft are formed on the outer peripheral surface of the rotor, the inner peripheral surface of the liner or the peripheral surfaces of both of the rotor and the liner to prevent the flow of the powder raw material in the direction toward which the powder raw material is flown. As a result, since a speed of ground particles entered the gap between the rotor and the liner and flowing to the discharge port is lowered and further they are sprung out to the supply port side by the convexities of the grooves of the rotor, a period of time during which the ground particles stay in the grinding chamber can be increased even if an interval of the gap, that is, a space of the grinding chamber is maintained to a large size. Consequently, according to the present invention, since the occurrence of excessive swirls and excessive collision can be prevented, the powder raw material is prevented from being excessively ground, and since the residence time of ground particles in the grinding chamber can be increased, a particle size can be reduced as well as the occurrence of large particles can be prevented.

DETAILED DESCRIPTION OF THE INVENTION

Although a mechanical grinding apparatus according to the present invention will be described in detail based on preferable embodiments shown in the accompanying drawings, the present invention is not limited thereto.

Figure 1:
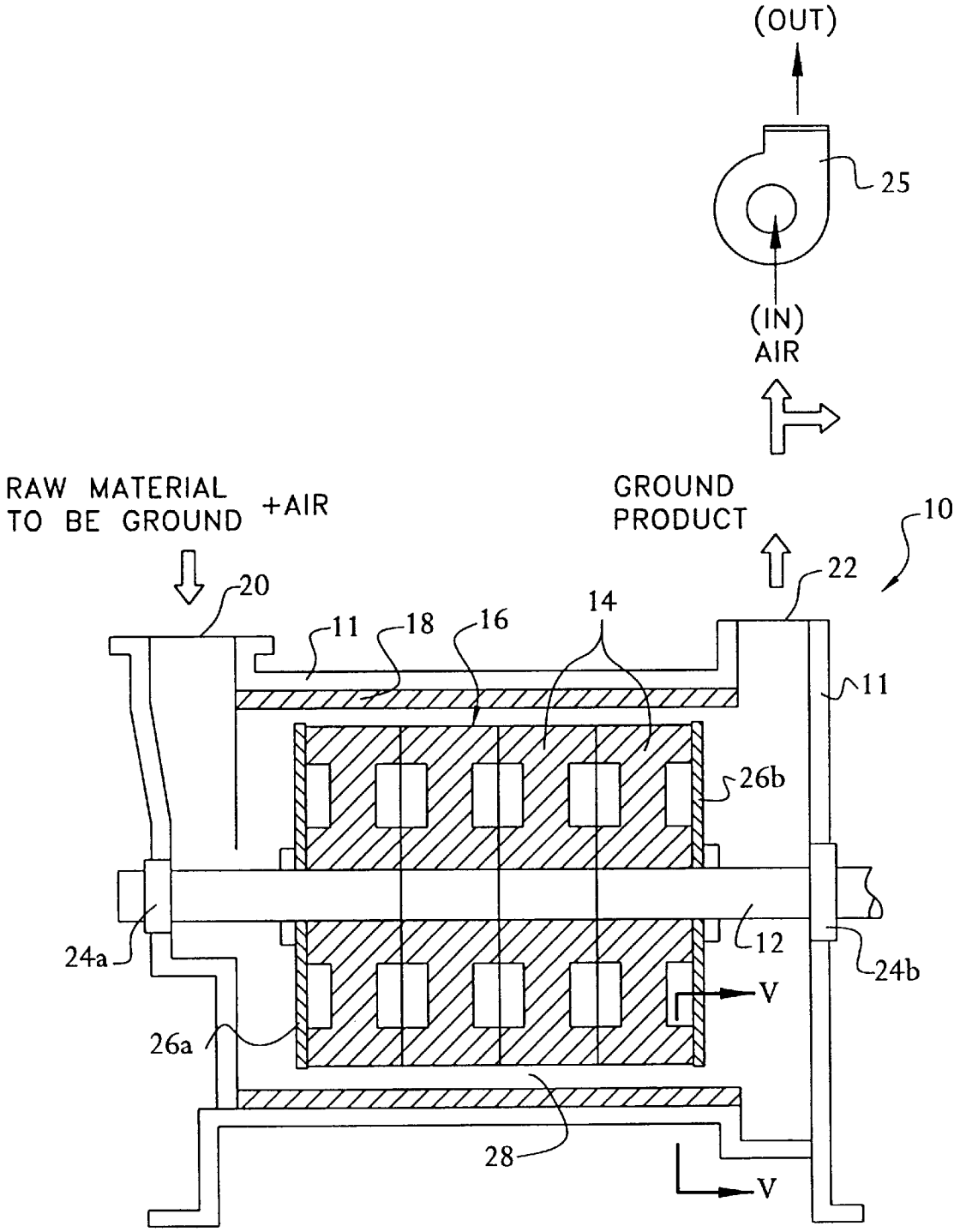
FIG. 1 is a schematic cross sectional view of an embodiment of a mechanical grinding apparatus according to the present invention.

FIG. 1 is a schematic cross sectional view of an embodiment of the mechanical grinding apparatus according to the present invention. Note, hatching is partially omitted in the accompanying drawings for simplification.

As shown in the drawing, a mechanical grinding apparatus (hereinafter, referred to as a grinding apparatus) 10 is composed of a horizontal grinding apparatus including a casing 11, a rotary shaft 12 rotatably supported by the casing 11, a rotor 16 composed of a plurality of rotor units 14 or four rotor units 14 in the illustrated embodiment which are supported by and secured to the rotary shaft 12 and a liner 18 supported by the casing 11 and inserted outside of the rotor 16 to have a certain desired gap between the outer peripheral surface of the rotor 16 and the inner peripheral surface of the liner. The casing 11 has a material supply port 20 for supplying a raw material (a substance to be ground) and a product discharge port 22 for discharging a ground product disposed on the left side and on the right side in the drawing, respectively.

In the mechanical grinding apparatus 10, the rotary shaft 12 is disposed in parallel with a plane on which the mechanical grinding apparatus 10 is mounted or disposed horizontally and supported by both the right and left walls of the casing 11 through bearings 24*a* and 24*b*. An end of the rotary shaft 12 or the right end thereof (on the side of the bearing 24*b*) in the illustrated embodiment is coupled with a drive unit such as a motor or the like through a wrapping transmission mechanism (not shown) composed of pulleys and a transmission belt, or the like, a gear transmission mechanism (not shown) or the like.

The four rotor units 14 are secured to the rotary shaft 12 through keys (not shown) and arranged as an integral unit by circular side plates 26*a* and 26*b* holding them from both sides thereof to thereby constitute the rotor 16. Although the rotor 16 is composed of the four rotor units 14 divided into the lengthwise direction thereof in the illustrated embodiment, this is only for the purpose of convenience in production. That is, it is needless to say that the present invention is not limited to the above arrangement and the number of the rotor units 14 constituting the rotor is not limited and the rotor 16 can be composed of a single rotor made as an integral unit as a whole.

Although the liner 18 is inserted to the outside of the rotor 16 with the certain gap defined therebetween, the gap 28 partitioned between the outer peripheral surface of the rotor 16 and the inner peripheral surface of the liner 18 serves as a material grinding chamber. The liner 18 is fitted and secured to the interior of a cylindrical barrel at the center of the casing 11. Further, volumes and shapes on both the sides of the casing 11 are set so that a space having a suitable size can be formed on each of both the outer sides of the liner 18 (and the rotor 16) and the space on the left side in the drawing communicates with the material supply port 20 and the space on the right side in the drawing communicates with the product discharge port 22 of the ground product (ground substance). The product discharge port 22 is sucked by an air suction device such as a blower or the like so that a feed substance supplied from the material supply port 20 is sucked together with air and a product obtained by being ground in the apparatus is discharged from the product discharge port 22 together with air. Further, the casing 11 has a leg portion on the lower surface thereof and mounted on a mounting table (not shown).

Figure 2:
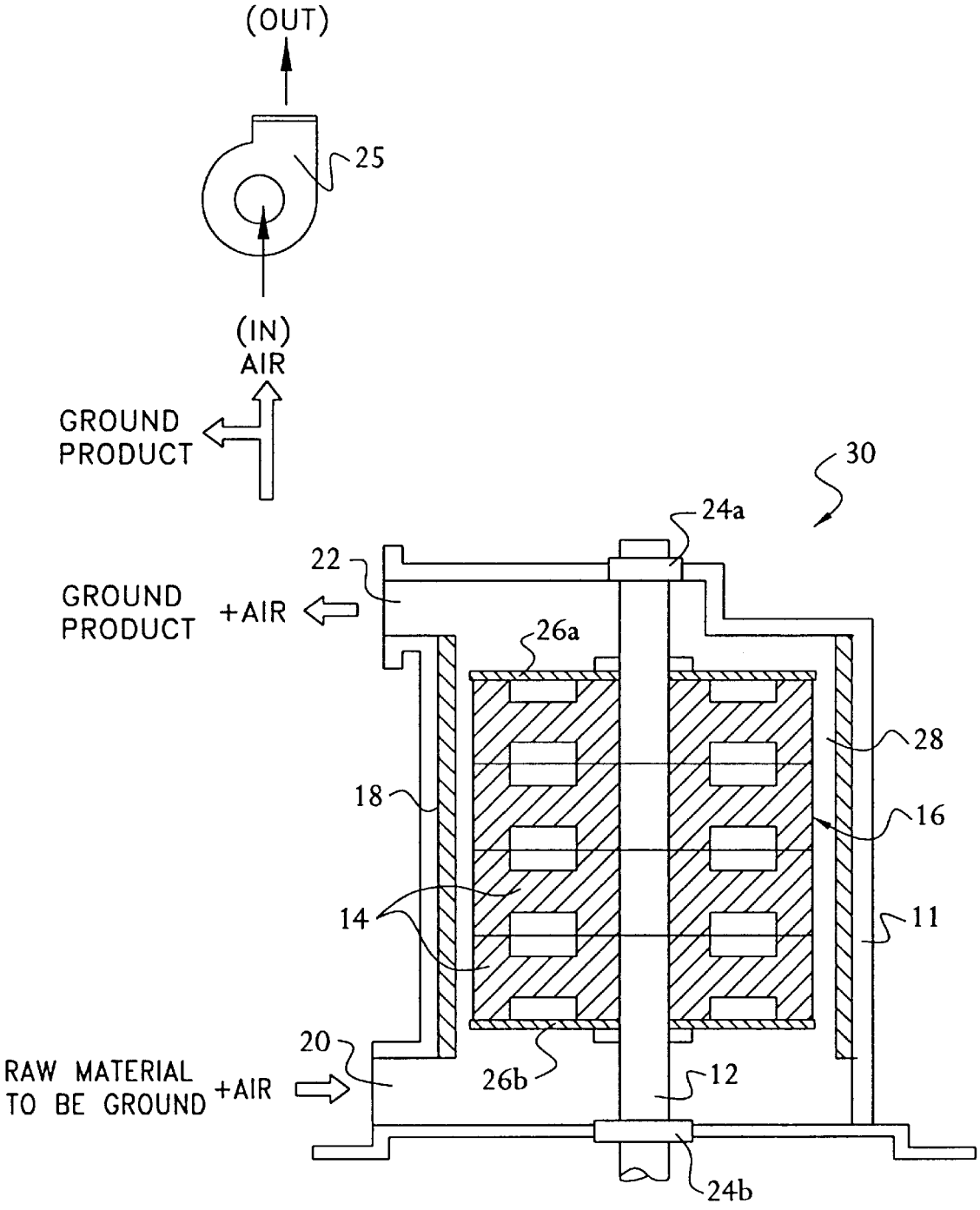
FIG. 2 is a schematic cross sectional view of another embodiment of the mechanical grinding apparatus according to the present invention.

Although the mechanical grinding apparatus 10 of the present invention is basically arranged as described above, the present invention is not limited to the horizontal grinding apparatus shown in FIG. 1 and may be composed of any grinding apparatus, so long as it is equipped with basic constitutional elements similar to those described above, such as, for example, a vertical grinding apparatus 30 as shown in FIG. 2 which has such a structure that a rotary shaft 12, a rotor 16 supported by the rotary shaft 12 and a liner 18 inserted to the rotor 16 with a predetermined gap defined therebetween are vertically disposed, a material supply port 20 is disposed on the lower portion of a casing below the liner 18 and a product discharge port 22 is disposed on the upper portion of the casing 11 above the liner 18, and the apparatus may be suitably modified based on the structures of known technologies.

The most characteristic portion in the mechanical grinding apparatus 10 of the present invention is that a plurality of grooves are formed on at least one or both of the outer peripheral surface of the rotor 16 and the inner peripheral surface of the liner 18 and that the grooves are inclined in a direction preventing the flow of a substance to be ground with respect to a direction parallel with the rotary shaft 12.

Figure 3:
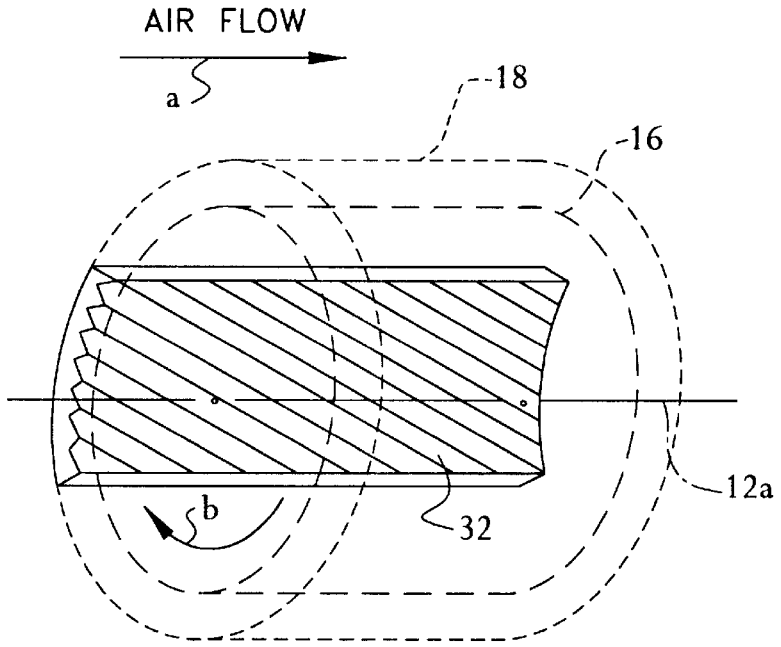
FIG. 3 perspective view of an embodiment of a liner used in the mechanical grinding apparatus shown in FIG. 1.

That is, as shown in FIG. 3, grooves 32 are defined on the inner peripheral surface of the liner 18 and arranged such that only the enveloping lines of the grooves are inclined in a direction opposite to the rotational direction (shown by an arrow b in the drawing) of the rotor 16 shown by a dotted line with respect to a direction parallel with the center of rotation (center line) 12*a* of the rotary shaft 12 shown by a dot-dash-line. Note, the liner 18 is shown only as a liner unit constituting a one sixth portion thereof in FIG. 3 and the other portion thereof is shown by a wrapping line using a dotted line. It is of course needless to say that the number of the liner units constituting the liner 18 is not limited and the liner 18 may be made of a single cylindrical body.

Note, the direction parallel with the rotary shaft 12 in the present invention is a direction parallel with the center of rotation 12*a* of the rotary shaft 12 and means a direction shown by an arrow a in the drawing toward which air flows and thus the direction coincides with the lengthwise direction of the rotor 16 or the liner 18 and the generating line direction thereof.

At least one group of the grooves 34 on the outer peripheral surface of the rotor 16 and the grooves 32 on the inner peripheral surface of the liner 18 are inclined in the direction preventing the flow of the substance to be ground (particles) with respect to the direction parallel with the rotary shaft 12 in the present invention. As schematically shown by being expanded in FIG. 4, a vector of a moving speed (a vector of a particle flow speed) of a feed substance moving in the gap 28 between the outer peripheral surface of the rotor 16 and the inner peripheral surface of the liner 18 is given by a composite vector of a vector of a rotational speed of the rotor 16 (direction: rotational direction b, length: speed) and a vector of an air flowing speed (direction: flowing direction a, length: speed). Thus, the grooves 32 on the inner peripheral surface of the liner 18 are disposed in a direction across the direction of the vector of a resulting particle flow speed (shown by an arrow c in the drawing) and preferably in a direction perpendicular thereto. That is, the grooves 32 are disposed to incline with respect to the air flow direction a in FIG. 4. Although an inclining angle θ of the grooves 32 with respect to the air flow direction a is not particularly limited so long as the grooves 32 are inclined at an acute angle toward the direction preventing the particle flow, it is preferably 5° or more to less than 90°, more preferably 5°–60°, much more preferably 5°–45° and most preferably 10°–30°.

Figure 5A:
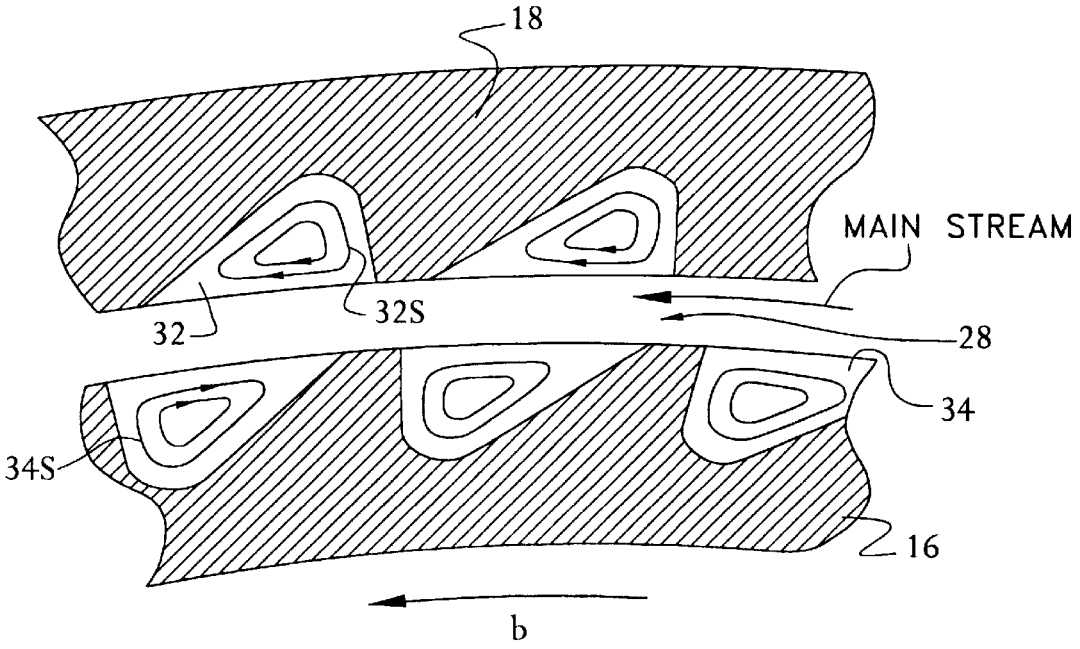
FIG. 5*a* is a partly cross sectional view in the cross section of the grooves including the schematic images of the steamlines of the aireddys in the grooves of the rotor and liner taken along the line V—V of FIG. 1, FIG. 5*b* and FIG. 5*c* are partly cross sectional views showing an example of the cross sectional shape of the grooves of a liner shown in FIG. 5*a* which is perpendicular to a groove direction, respectively.

A shape and dimensions including a width, a depth, a pitch and the like of the grooves on the inner peripheral surface of the liner 18 which are inclined with respect to the air flow direction a (hereinafter, referred to as inclined grooves) are not particularly limited, and, for example, the shape of each of the inclined grooves 32 on the cross section thereof perpendicular to the direction along the grooves 32 of the liner 18 may be any of a trapezoid shape, a rectangular shape, an arc shape and the like. However, a particularly preferable shape is a triangular shape having a side directed to the center of the rotor 16 and another side having an angle of 45°–60° with respect to the above side and lowered toward the rotational direction b of the rotor 16 (as disclosed in Japanese Patent Publication No. 3-15489), as shown in FIG. 5*a*.

Figure 5B:
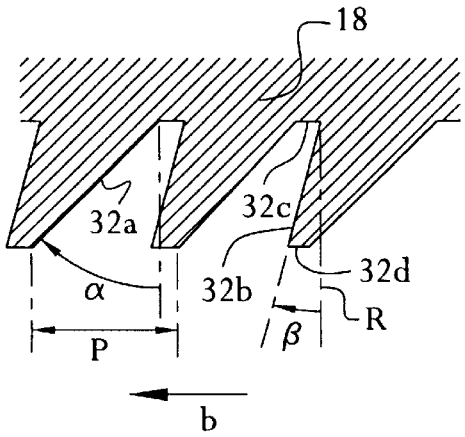
FIG. 5*d* and FIG. 5*e* are partly cross sectional view showing an example of the cross sectional shape of the grooves of a rotor shown in FIG. 5*a* which is perpendicular to a groove direction, respectively.
FIG. 5*f* is a schematic view showing an example of the grinding operation of the grooves of the rotor and liner and FIG. 5*g* is a schematic view showing an example of the aireddys generated in the groove of the rotor.
Figure 5C:
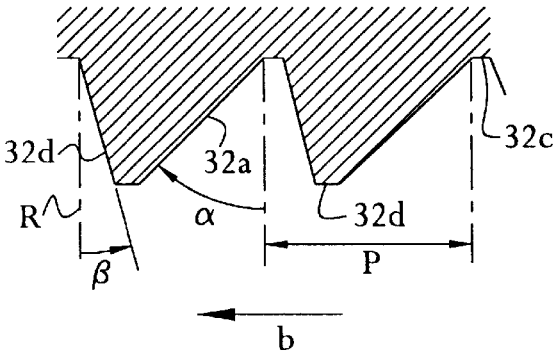

For example, FIG. 5*b* and FIG. 5*c* show typical examples of the cross sectional shape of the inclined grooves 32 of the liner 18 in the cross section thereof perpendicular to the direction of the inclined grooves 32 of the liner 18. As shown in FIG. 5*b* and FIG. 5*c*, in the cross sectional shape of the grooves 32 of the liner 18, a front side surface 32*a* located forwardly of the rotational direction b of the rotor 16 is inclined a predetermined angle α in the rotational direction b of the rotor 16 with respect to the central direction of the rotor 16, that is, the direction shown by a dot-dash-line R in the drawing and a rear side surface 32*b* located rearwardly of the rotational direction b is inclined a predetermined angle β in the rotational direction b or the direction opposite to the rotational direction with respect to the central direction R. It is preferable that the inclination angles α and β of the cross section of the grooves 32 are within the range of 30° to 70° and −30° to 30° (from 30° in the direction opposite to the rotational direction b to 30° in the rotational direction b), respectively.

Further, in FIG. 5*b* and FIG. 5*c*, it is preferable that the bottom portion 32*c* of the grooves 32 of the liner 18 and the convex portion 32*d* of the liner 18 between the adjacent grooves 32 are one half or less the pitch p of the grooves 32. Note, the bottom portion 32*c* of the grooves 32 of the liner 18 is formed to the apex of a triangle or to have a round shape without forming a straight portion as shown in FIG. 5*b* and FIG. 5*c* and is more preferably formed to an arc shape as shown in, for example FIG. 5*a*.

As described above, when the above inclined grooves are defined on the inner peripheral surface of the liner 18, the particles of the substance (raw material) ground in the gap 28 constituting the grinding chamber between the rotor 16 and the liner 18 and entered the inclined grooves 32 of the liner 18 are difficult to move toward the flow direction of air sucked from the product discharge port 22 by the blower 25 or the like so that they can stay in the grinding chamber for a long period of time while a wide space is held for the grinding chamber.

Figure 6:
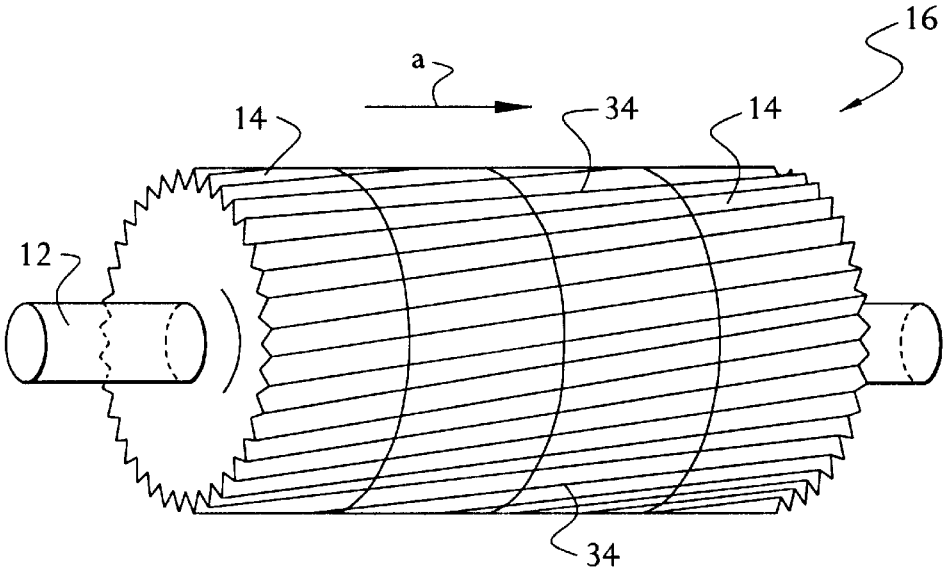
FIG. 6 is a perspective view of an embodiment of a rotor used in the mechanical grinding apparatus shown in FIG. 1.

In the present invention, although the inclined grooves are not limited to the inclined grooves 32 defined on the inner peripheral surface of the liner 18 and may be defined on any one of the outer peripheral surface of the rotor 16 and the inner peripheral surface of the liner 18, they may be defined on the peripheral surfaces of both of them. When inclined grooves 34 are defined on the outer peripheral surface of the rotor 16 as shown in FIG. 6, it is preferable to accurately align the keyways (not shown) of the four rotor units 14 for securing them to the rotary shaft 12 so that the inclined grooves 34 are not dislocated on the surfaces, where the adjacent rotor units 14 of the four rotor units 14 constituting the rotor 16 are joined to each other, and smoothly continued. Note, an inclining angle of the inclined grooves 34 of the rotor 16 is not particularly limited. Likewise, that of the inclined grooves 32 of the liner 18 and the preferable conditions of the inclined grooves 34 are similar to those of the inclined grooves 32. Note, a shape and dimensions of the inclined grooves 34 of the rotor 16 are also not particularly limited. Likewise, those of the inclined grooves 32 of the liner 18 and any shape may be employed. However, a particularly preferable shape of the inclined grooves 34 is such that the shape of each of the inclined grooves 34 on the cross section thereof perpendicular to the direction along the groove 34 of the rotor 16 is formed to a triangular shape including one side having an angle of 5°–25° toward the rear side of the rotational direction b of the rotor 16 and another side having an angle of 45°–60° toward the above rear direction with respect to a radius directing to the center of the rotor 16, respectively, as shown in FIG. 5*a*.

Figure 5D:
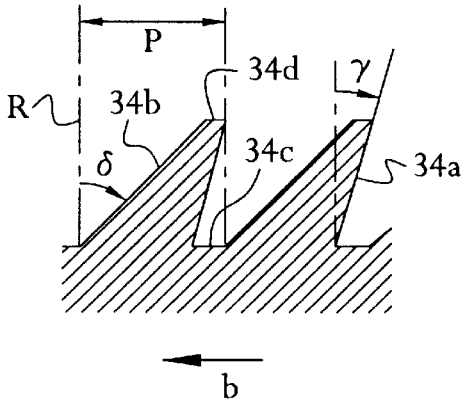
Figure 5E:
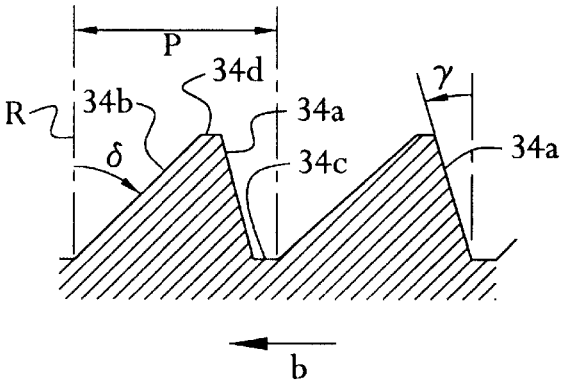

For example, FIG. 5*d* and FIG. 5*e* show typical examples of the cross sectional shape of the inclined grooves 34 of the rotor 16 in the cross section thereof perpendicular to the direction of the inclined grooves 34 of the rotor 16. As shown in FIG. 5*d* and FIG. 5*e,* in the cross sectional shape of the grooves 34 of the rotor 16, a front side surface 34*a* located forwardly of the rotational direction b of the rotor 16 is inclined a predetermined angle γ in the rotational direction b of the rotor 16 or the direction opposite to the rotational direction with respect to the radial direction from the center of the rotor 16, that is, the direction shown by a dot-dash-line R in the drawing, and a rear side surface 34*b* located rearwardly of the rotational direction b is inclined a predetermined angle δ in the rotational direction b with respect to the radial direction R. It is preferable that the inclination angles γ and δ of the cross section of the inclined grooves 34 are within the range of −30° to 30°, that is, 30° in the direction opposite to the rotational direction b to 30° in the rotational direction b and −70° to −30°, that is, within the range of 30° to 70° in the direction opposite to the rotational direction, respectively.

Further, in FIG. 5*d* and FIG. 5*e,* it is preferable that the bottom portion 34*c* of the grooves 34 of the rotor 16 and the convex portion 34*d* of the rotor 16 between the adjacent grooves 34 are one half or less the pitch p of the grooves 34. Note, the bottom portion 34*c* of the grooves 34 of the rotor 16 is formed to the apex of a triangle or to have a round shape without forming a straight portion as shown in FIG. 5*d* and FIG. 5*e* and is more preferably formed to an arc shape as shown in, for example, FIG. 5*a*.

As preferred embodiments of the present invention, cross sectional shapes of the grooves 32 and 34 will be explained hereunder with accompaniment of reasons for the restriction.

In the grinding apparatus 10 according to the present invention, appropriately stable air eddies or vortexes not excessively disturbed by the rotation of the rotor 16 are preferably formed respectively in the grooves 32 of the liner 18 and the grooves 34 of the rotor 16 as illustrated schematically by FIG. 5*a*. Since the air eddies are effective in preventing excessive rise in the exhaust gas temperature, that is, rise in the grinding temperature and rise in the grinding power, forming the aireddys results in improvements of the grinding capacity of the apparatus. In FIG. 5*a,* the reference number 32S denotes an image of the streamline of the aireddys in the groove 32 of the liner 18 generated by the rotation of the rotor 16, and the reference number 34S denotes an image of the streamline of the aireddys in the groove 34 of the rotor 16.

Figure 5F:
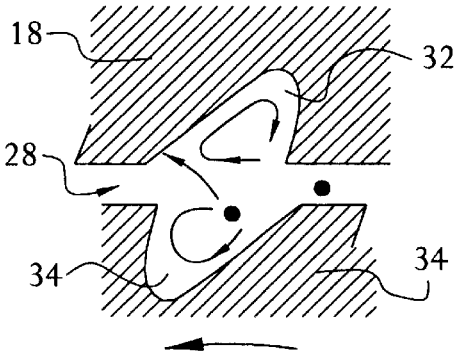

The feed substance particles charged into the grinding chamber 28 are sucked into the grooves 34 of the rotor 16 by means of the aireddys generated in the grooves 34 of the rotor 16, are brought into collision with the rear side surface 34*b* to be rebound in the direction of the liner 18, collide with the front side surface 32*a* of the liner 18, and are thereby ground (See FIG. 5*f*).

Among the ground feed substance particles, coarse particles are unable to be carried away by the aireddys generated in the grooves 32 of the liner 18, and are returned to the grinding chamber 28 to be subjected again to the same action. On the contrary, fine particles are entrained by the aireddys generated in the grooves 32 of the liner 18 or the grooves 34 of the rotor 16 to remain within the groove 32 or groove 34, subjected to changing pressure of the aireddys caused by the high speed alternating encounters with the convex portions and concave portions of the grooves 32 of the rotor 16 and the grooves 34 of the liner 18, and ground into the particles of specified sizes.

In consideration of the grinding process mentioned above, the cross sectional shape of the groove is to be determined as mentioned hereunder.

Since the rear side surface 34*b* of the groove 34 of the rotor 16 has an inclination which causes not an excessive turbulence in the streamline, prevents temperature rises in the exhaust air, and repulses the feed substance particles colliding with the surface in the direction of the liner 18, the inclination angle δ is preferably equal to or larger than 30° but is equal to or smaller than 70° in the direction opposite to the rotational direction b of the rotor 16 with respect to the radial direction.

Since the front side surface 32*a* of the groove 32 of the liner 18 has an inclination which provides the feed substance particles with appropriate impact upon repulsion by the rotor 16, the inclination angle α is preferably equal to or larger than 30° but is equal to or smaller than 70° in the rotational direction b of the rotor 16 with respect to the central direction.

The aireddys in the grooves 34 of the rotor 16 and the grooves 32 of the liner 18 are necessary to have appropriately magnitude of vorticity to be present in a large space, and be stable. For that purpose, the inclination angle γ of the front side surface 34*a* of the groove 34 of the rotor 16 and the inclination angle β of the rear side surface 32*b* of the groove 32 of the liner 18 are to be larger than 0° and smaller than 0° respectively, to provide the large spaces for the grooves 32 and 34.

Figure 5G:
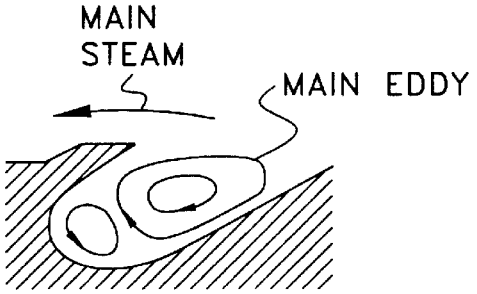

However, when the front side surface 34*a* of the groove 34 of the rotor 16 is formed to have an excessively large inclination angle γ in the direction opposite to the rotational direction b, subsidiary aireddys are generated together with the main aireddys to cause retention in the grooves 34 of coarse particles requested to be driven out therefrom, and mingling of the retained coarse particles into the product. In the above, the main aireddys are principally those acting on particles to grind them, which are mentioned in FIG. 5*a* by reference numbers 32S and 34S (See FIG. 5*g*).

When the inclination angle γ in the direction opposite to the rotational direction b is too large, the aireddys generated in the grooves 34 tend to flow out into the main stream to make them unstable, or the main stream tends to flow into the grooves 34 to reduce the size of the aireddys.

In consideration of the above, the inclination angle γ is settled preferably to be equal to or larger than −30° but equal to or smaller than 30°, that is, to be within the range of from 30° in the direction opposite to the rotational direction b to 30° in the rotational direction b.

Further, based on the similar reasons, the inclination angle β of the rear side surface 32*b* of the groove 32 of the liner 18 is equal to or larger than −30° but equal to or smaller than 30°, that is, to be within the range of from 30° in the direction opposite to the rotational direction b to 30° in the rotational direction b.

The pitch of the grooves preferable to the present invention are as explained below.

For the rotor 16 having an identical diameter, a narrowed pitch p of the grooves increases the number of grooves 32 and 34, which is preferable to obtain fine particles due to an increased probability for the particles to collide with the side surfaces 32*a*, 32*b*, 34*a* and 34*b* of the grooves 32 and 34. However, since the depth of the grooves 32 and 34 are to be settled within a specified range suitable for generating stable and properly strong aireddys while suppressing formation of the aireddys other than the main aireddys, a too narrowed pitch makes the groove space too small inducing problems of reduction in the processing capacity, etc.

Accordingly, though the pitch p of grooves may vary depending on the kind of feed substance to be ground, particle size of the feed substance, particle size of the product, etc., the pitch p of grooves for the present invention is preferably settled at around 2–10 mm.

Further, the depth of the grooves 32 and 34 is preferably settled at between ⅕ and 3 times of the pitch p of the grooves.

The pitch and depth of the groove 34 of the rotor 16 and the pitch and depth of the groove 32 of the liner 18 are preferably the same, respectively, but may be different.

When the inclined grooves 34 are defined on the outer peripheral surface of the rotor 16 as described above, the particles of a feed substance, which enter the gap 28 constituting the grinding chamber between the rotor 16 and the liner 18 and collide against the convexities 34*d* (refer to FIG. 5*d* and FIG. 5*e*) defined by the inclined grooves 34 of the rotor 16, are sprung out in a direction opposite to the direction toward which air sucked (on the side of the material supply port 20) by the blower 25 or the like from the product discharge port 22 flows. Therefore, a period of time during which the particles stay in the grinding chamber can be increased.

Figure 7A:
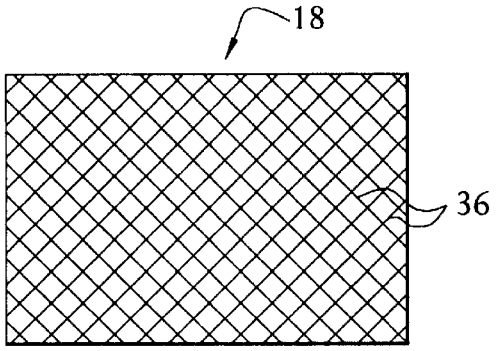
FIG. 7*a* and FIG. 7*b* are schematic front elevational views of another embodiments of the liner and the rotor used in the mechanical grinding apparatus of the present invention, respectively.

Further, when the inclined grooves are defined only on any one of the outer peripheral surface of the rotor 16 and the inner peripheral surface of the liner 18, grooves parallel with the center line 12*a* of the rotary shaft 12 may be defined on the other one of the peripheral surfaces of the rotor 16 and the liner 18. In addition, a plurality of inclined grooves which cross each other at the same or a different inclining angle with respect to the center line of the rotary shaft 12 (longitudinal direction) may be defined on any one or both of the peripheral surfaces, that is, inclined grooves 36 formed to meshes when viewed from the front side thereof may be defined as shown in the liner 18 of FIG. 7*a* and the rotor 16 of FIG. 7*b*.

Note, a method of defining the above inclined grooves is not particularly limited and any known methods such as a method of defining concavities on a peripheral surface by cutting or the like, a method of defining convexities by casting or the like, and the like are applicable. Further, wear-resistant processing may be applied at the time when necessary.

An interval of the gap 28 serving as the grinding chamber between the outer peripheral surface of the rotor 16 and the inner peripheral surface of the liner 18 is not particularly limited also in the present invention and can be suitably selected depending upon a type and a material of a feed substance and a particle size distribution of a ground product. In the present invention, however, the interval can be made larger than a conventional one due to the existence of the inclined grooves which are characteristic to the invention and the interval can be set to a width of 3 mm at its maximum.

Operation of the mechanical grinding apparatus of the present invention basically arranged as described above will be described in detail with reference to FIGS. 1 and 3 to 7*b*.

First, operation of the suction blower connected to the product discharge port 22 through a ground product collecting filter is started so that air flown from the material supply port 20 is made into air flow from the left side to the right side in FIG. 1 in the grinding apparatus. Then, the rotor 16 is rotated in the direction of the arrow b in FIG. 3.

Next, a desired amount of a powder raw material is continuously or intermittently supplied from the material supply port 20. Then, the supplied powder raw material is sucked together with the air flow and reaches the gap 28 serving as the grinding chamber between the rotor 16 and the liner 18. Successively, the powder raw material is ground by being subjected to shear force caused by friction between both the convexities of the inclined grooves 32, 34 and repeats collision against the convex surfaces of the inclined grooves 32, 34 and collision against the concave surfaces thereof caused by the swirls produced therein and further collision against each other, so that the powder raw material gradually moves toward a right direction while being suitably ground, sucked and discharged from the product discharge port 22 as a ground product and captured by the ground product collecting filter outside of the apparatus.

Figure 4:
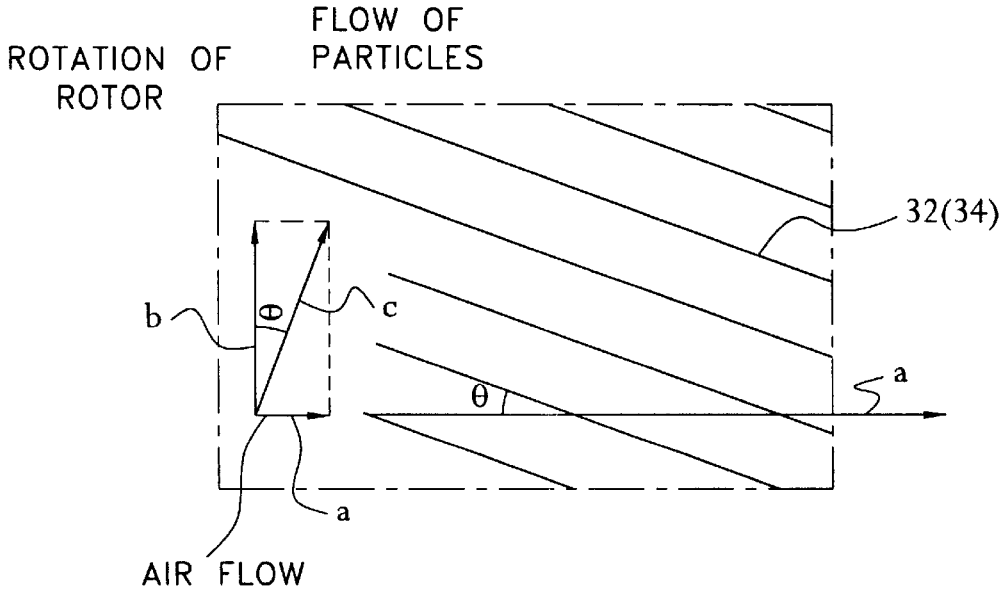
FIG. 4 is a schematic view explaining an angle of inclined grooves formed on a rotor or a liner of the mechanical grinding apparatus according to the present invention.

In the grinding process, the inclined grooves operate as shown in FIG. 4. That is, as shown by the arrows a, b and c in FIG. 4, since the rotating direction b of the rotor 16 is a direction perpendicular to the air flow direction a, the particles of the powder raw material entered the gap 28 between the rotor 16 and the liner 18 together with the air flow is flown in the rotational direction b and advances approximately in a direction c. Consequently, the particles of the powder raw material are drawn into or taken into the inclined grooves 32 of the liner 18 and the inclined grooves 34 of the rotor 16 directly or by the swirls produced by these inclined grooves 32 and 34 or caused to collide thereagainst and sprung out in an opposite direction so that they are prevented from moving toward the air flow direction a. Consequently, since the particles are prevented from smoothly moving toward the air flow direction a, a residence time of the particles in the grinding chamber composed of the gap 28 can be increased. Since the inclined grooves 32 and 34 operate to prevent the flow of the particles of the powder raw material in the grinding chamber, a volume of the grinding chamber (an interval of the gap 28) can be increased (the interval of the gap is 3 mm at its maximum), thus even if an amount of the powder raw material to be processed is increased, a sufficient grinding period of time can be secured. When the space of the grinding chamber is increased as described above, excessively violent disturbance and irregular disturbance are not contained to the swirls produced by the inclined grooves 32 and 34 and the particles of the powder raw material can be gradually ground. As a result, the powder raw material is prevented from being excessively ground regardless of any increase in the residence time of the powder raw material in the grinding chamber.

Note, in the mechanical grinding apparatus 10 of the present invention, it is preferable that the suction force made by the suction blower 25 and the rotational speed of the rotor 16 are suitably selected and set in accordance with a type, a particle size, a feed rate of a powder raw material to be ground (substance to be ground), a dimension and a shape of the rotor 16 and the liner 18, a shape and a dimension of the inclined grooves, an interval of the gap serving as the grinding chamber and the like. For example, in a mechanical grinding apparatus including a rotor having a diameter of about 250 mm and an axial length of about 250 mm, it is suitable that the suction blower 25 has an air flow rate of about 4–6 $m^3$/min and the rotor has rotational speed of about 6,000–13,000 r.p.m.

As described above in detail, according to the present invention, since the outer peripheral surface of the rotor, the inner peripheral surface of the liner or both of them have a plurality of the grooves defined thereon which are inclined in the direction preventing the flow of a powder raw material as a feed substance to be ground with respect to the direction parallel with the rotary shaft of the rotor, the passage of the powder raw material in the grinding chamber composed of the gap defined between the rotor and the liner is prevented by these grooves, so that the residence time of the powder raw material in the grinding chamber can be increased. As a result, fine powder of high quality can be obtained which has a small particle size of, for example, an order of 5–15 μm, a sharp and narrow particle size distribution width and no large particles.

Further, according to the present invention, since the occurrence of large particles is prevented and since powder raw material is ground under the gentle grinding conditions, the powder raw material is prevented from being excessively ground and the occurrence of fine particles having a particle size smaller than necessary such as a particle size of, for example, 5 μm or less or several microns or less can be reduced. In addition, according to the present invention, since the volume of the grinding chamber can be increased, a feed rate can be also increased.

Consequently, the mechanical grinding apparatus of the present invention is suitable to grind powder raw material composed of resin or mainly composed of resin and, in particular, suitable to grind dry toner and powder paint.

EXAMPLES

Examples of the present invention are given below by way of illustration and not by way of limitation.

(Example 1)

A mono-component toner having a median particle size of 500 μm as a powder raw material was ground using the mechanical grinding apparatus 10 having the structure shown in FIG. 1 under the following conditions.

A plurality of the inclined grooves 32 are defined on the inner peripheral surface of the liner 18 as shown in FIG. 3 and FIG. 4 and an inclining angle θ thereof was set to 10°. On the other hand, grooves parallel with a generating line direction (hereinafter, referred to as a "parallel grooves") were defined on the outer peripheral surface of the rotor 16. Further, a cross sectional shape of each of the inclined grooves 32 and the parallel grooves are as shown in FIG. 5 and the inclined grooves 32 and the parallel grooves had a groove pitch and a groove depth set to 4 mm and 2 mm, respectively. In addition, the rotor 16 had a diameter set to 242 mm, a length set to 240 mm and a gap between the rotor 16 and the liner 18 was set to 2 mm.

The suction blower 25 was connected to the product discharge port 22 of the mechanical grinding apparatus 10 through a ground product collecting filter and a toner material was supplied from the material supply port 20 by a screw type feeder.

The mechanical grinding apparatus 10 was operated, with the rotational speed of the rotor 16 set to 10,000 r.p.m. and an air flow rate of the suction blower 25 set to 4 $m^3$/min, and grinding process was executed by changing a feed rate of the toner material to be processed to 10, 20 and 30 kg/h. A ground substance subjected to the grinding process and discharged from the product discharge port 22 was captured and collected by the ground product collecting filter having an average pore diameter of about 3 μm as a ground product.

Figure 8:
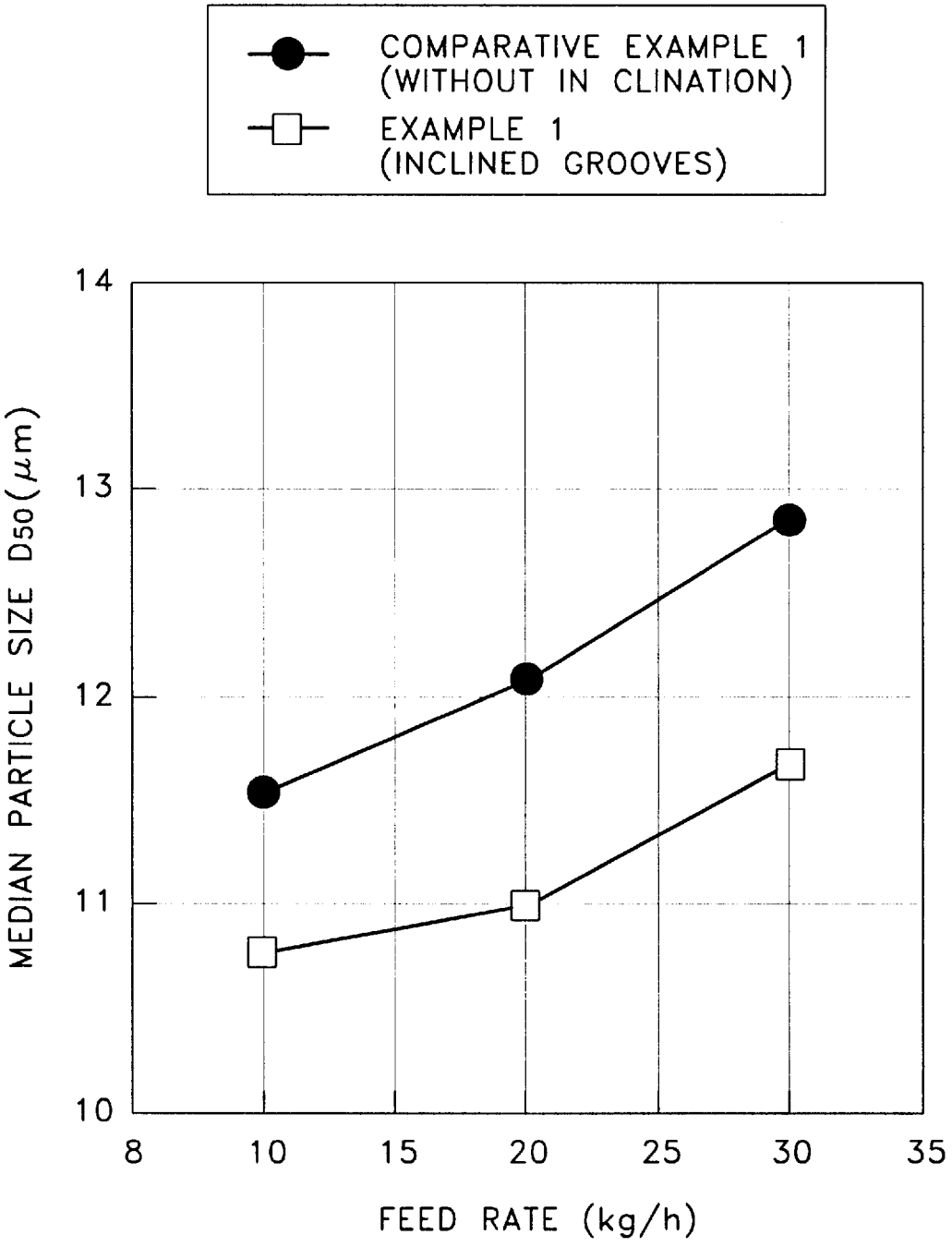
FIG. 8 is a graph showing the results of Example 1 and Comparative Example 1.

FIG. 8 shows a result that median particle sizes of the thus obtained ground product were measured and plotted with respect to feed rate.

(Comparative Example 1)

Grinding was also executed using the same mechanical grinding apparatus as that of Example 1 except that parallel grooves were defined on the inner peripheral surface of the liner 18 (the grooves were the same as those described in the grinding apparatus disclosed in Japanese Patent Publication No. 3-15489) under the same conditions as those of Example 1. A result of the grinding is also shown in FIG. 8.

As apparent from FIG. 8, it can be found that a ground product having a median particle size smaller than that of Comparative Example 1 was obtained by Example 1 using the mechanical grinding apparatus of the present invention. In addition, any increase of power and grinding temperature of the mechanical grinding apparatus which would be caused by the inclination of the grinding grooves was not recognized in Example 1.

(Example 2 and Comparative Example 2)

The same mechanical grinding apparatus as that of Example 1 was used as Example 2 and the same mechanical grinding apparatus as that of Comparative Example 1 was used as Comparative Example 2, and a toner material was ground and a ground product was obtained under the same conditions as those of Example 1 except that a feed rate of the toner material to be processed (supply speed) was fixed to 10 kg/h and the rotational speed of the rotor 16 was changed from 10,000 r.p.m. to 13,000 r.p.m. Median particle sizes of the thus obtained ground product and volume percentage of particles of 5 μm or less contained in the ground product were measured and a result of the measurement is shown in FIG. 9.

Figure 9:
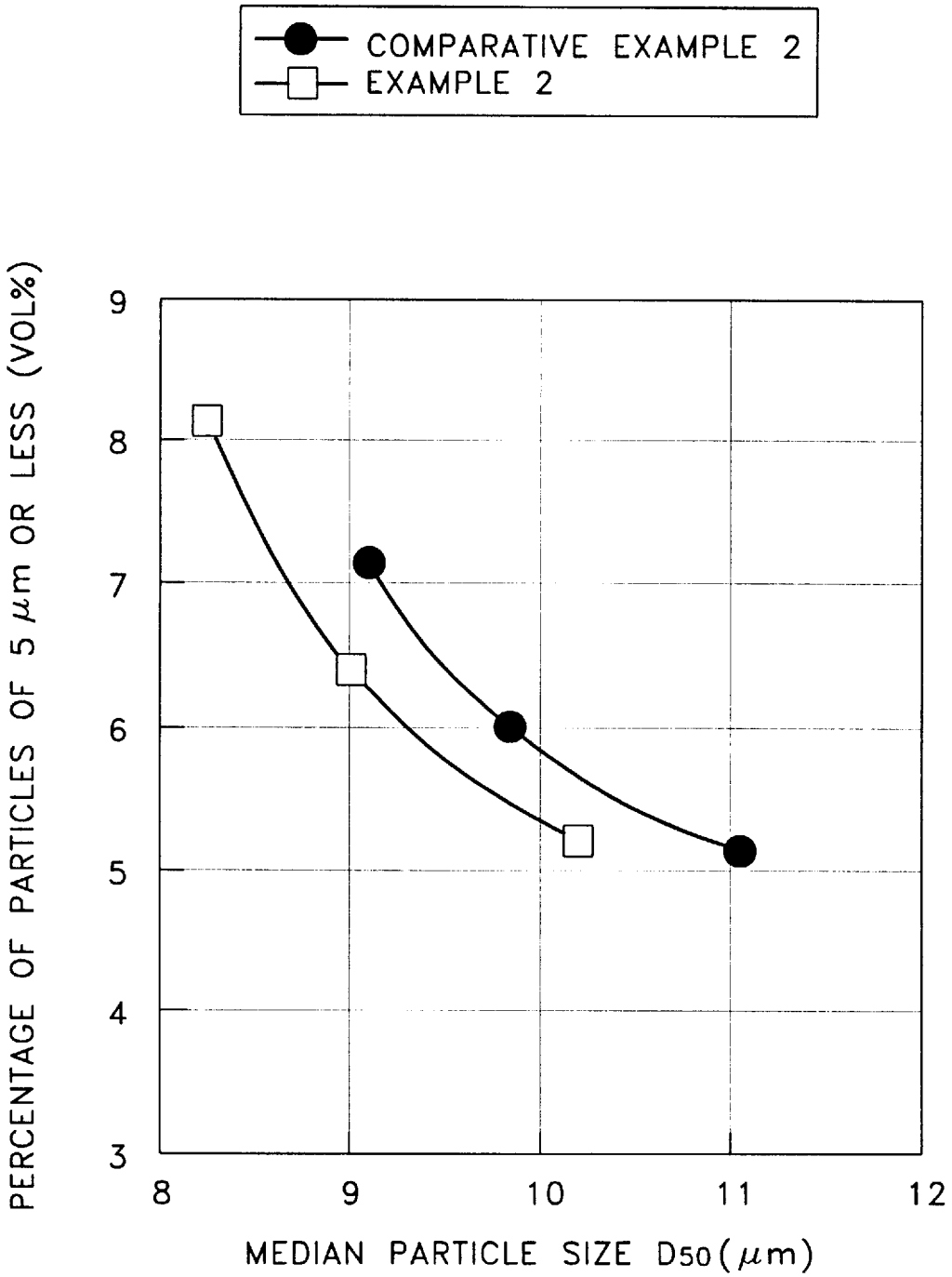
FIG. 9 is a graph showing the results of Example 2 and Comparative Example 2.

As apparent from FIG. 9, the percentage of particles of 5 μm or less contained in the product ground by the mechanical grinding apparatus of Example 2 of the present invention is smaller than that of the product ground by the grinding apparatus of Comparative Example 2 in the ground product having the same median particle size. It can be found from the result that an excessively finely ground product can be reduced by the mechanical grinding apparatus of the present invention.

(Example 3, Example 4 and Comparative Example 3)

A mono-component having a median particle size of 200 μm as a powder raw material was ground under the following conditions using the mechanical grinding apparatus 30 shown in FIG. 2.

Figure 7B:
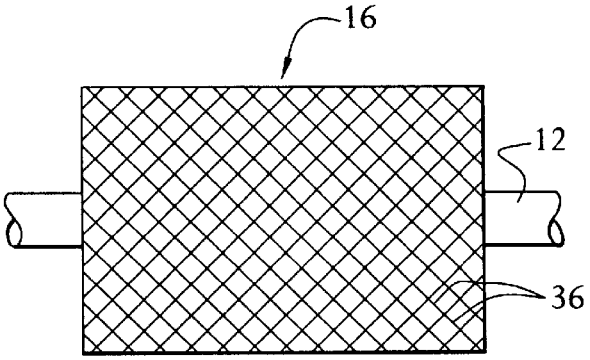

As Example 3, a plurality of the inclined grooves 34 were defined on the outer peripheral surface of the rotor 16 as shown in FIG. 4 and FIG. 6 and an inclining angle θ of the grooves 34 was set to 10°. Next, a plurality of the inclined grooves 36 were defined to a mesh shape on the outer peripheral surface of the rotor 16 as Example 4 as shown in FIG. 7*b* and an angle θ of the inclined grooves across each other was set to ±10° with respect to a generating line direction. Parallel grooves which are parallel with the generating line direction were defined on the outer peripheral surface of the rotor 16 as Comparative Example 3. On the other hand, parallel grooves which are parallel with the generating line direction were defined on the inner peripheral surface of the liner 18 used in any of the above examples. Further, a cross sectional shape perpendicular to the direction along the grooves and a size of the inclined grooves 34 and 36 and the parallel grooves were set similar to those of Example 1.

The mechanical grinding apparatus 30 was operated, with the rotational speed of the rotor 16 changed to 10,000 r.p.m., 11,000 r.p.m. and 12,000 r.p.m. and an air flow rate of the suction blower 25 set to 4 $m^3$/min, and grinding process was executed by setting a feed rate of a toner material to be processed (supply speed) to 10 kg/h. Other grinding conditions were set similar to those of Example 1 and a ground product was processed likewise Example 1.

Figure 10:
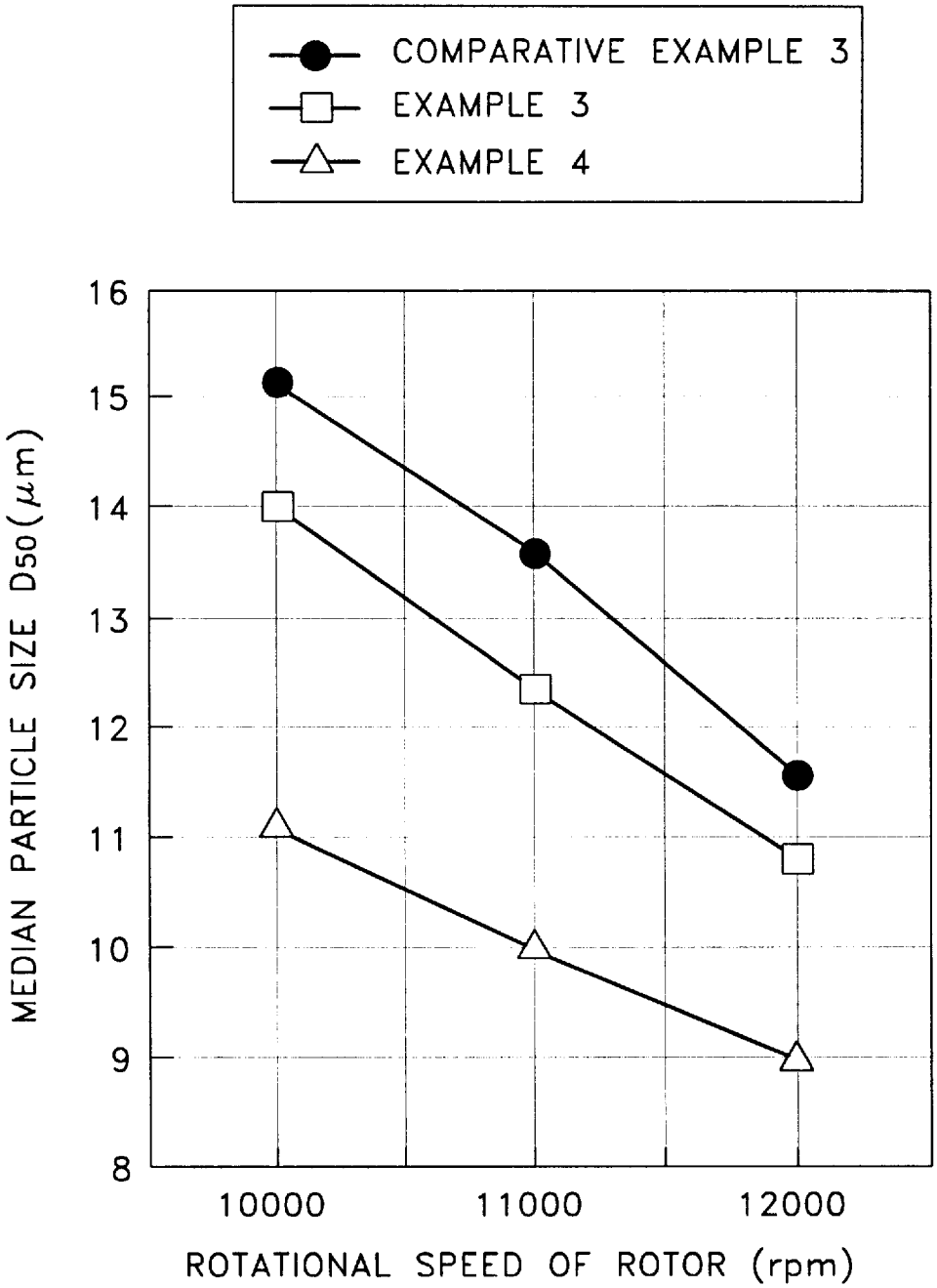
FIG. 10 is a graph showing the results of Example 3, Example 4 and Comparative Example 3.

FIG. 10 shows a result that median particle sizes of the thus obtained ground products were measured and plotted with respect to the rotational speed of the rotor.

As apparent from FIG. 10, it can be found that the particles size of the product ground by the mechanical grinding apparatus of Example 3 of the present invention are smaller than those of the product ground by the mechanical grinding apparatus of Comparative Example 3 in all the rotational speed of the rotor. It can be also found that a more remarkable difference is obtained when the particle sizes of the product ground by the mechanical grinding apparatus of Example 4 of the present invention with those of the product ground by the mechanical grinding apparatus of Comparative Example 3. Further, any increase of power and grinding temperature of the mechanical grinding apparatus which would be caused by the inclination of the grinding grooves were not also recognized in Example 3 and Example 4.

(Example 5)

A mono-component toner having a maximum particle size of 2 mm as a powder raw material was ground under the following conditions using the mechanical grinding apparatus 30 having the structure shown in FIG. 2.

As Example 5, a plurality of parallel grooves were defined in the direction parallel with the rotary shaft on the inner peripheral surface of the liner 18. The cross sectional shape of it was formed to a triangular shape having a side directed to the center of the rotor 16 and another side having an angle of 45° with respect to the above side and lowered toward the rotational direction of the rotor 16 (as disclosed in Japanese Patent Publication No. 3-15489).

On the other hand, both the of grooves inclined in a direction for preventing the flow of a grinding substance and grooves inclined in a direction opposite to the above direction with respect to a direction parallel with the rotary shaft were defined on the outer peripheral surface of the rotor 16 and the inclining angles of the grooves were set to 5°, 10°, 20° and 45°, respectively. That is, the inclined groves were defined to have a mesh shape on a front elevational view as the rotor 16 shown in FIG. 7*b*.

A groove pitch of 4 mm and a groove depth of 2 mm were set to the parallel grooves and the inclined grooves.

Further, the rotor 16 had a diameter of 242 mm and a length of 240 mm and a gap between the rotor 16 and the liner 18 was set to 2 mm.

The suction blower 25 was connected to the product discharge port 22 of the mechanical grinding apparatus 30 through a ground product collecting filter and the material toner was fed from the material supply port 20 by a screw type feeder.

The air flow rate of the suction blower 25 was set to 4 $m^3$/min, the feed rate of the toner material to be processed (feed speed) was set to 20 kg/h and the rotational speed of the rotor 16 was adjusted to make the particle size of a ground substance to 12 $\mu$m.

(Comparative Example 4)

Further, a test was carried out under the same operating conditions using the rotor 16 whose grooves defined on the outer peripheral surface thereof had an inclined angle set to 0°, that is, the rotor 16 to which grooves were defined in parallel with the rotary shaft.

To grind the material toner to a median particle size of 12 $\mu$m, the rotational speed of the rotor 16 was adjusted as described below in accordance with the inclined angle of the grooves on the outer circumferential surface of the rotor 16.

That is, when the inclined angle was 0°, the rotational speed of the rotor was adjusted to 11,000 r.p.m, when the inclined angle was 5°, the rotational speed of the rotor was adjusted to 10,500 r.p.m, when the inclined angle were 10° and 20°, the rotational speed of the rotor was adjusted to 10,000 r.p.m, and when the inclined angle was set to 45°, the rotational speed of the rotor was adjusted to 9,800 r.p.m.

Figure 11:
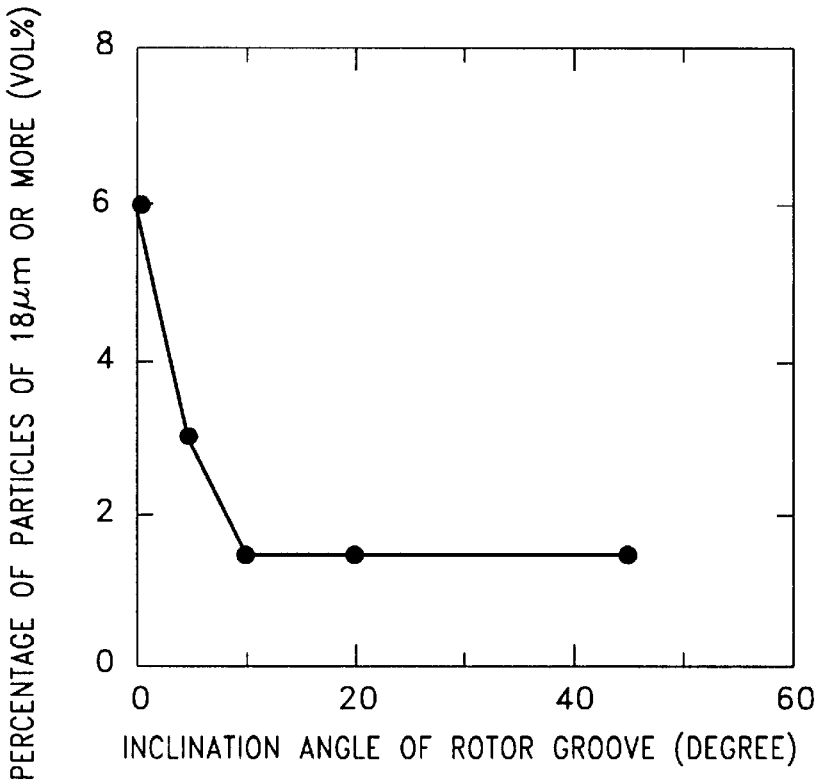
FIG. 11 is a graph showing a result of FIG. 5 and Comparative Example 4.

FIG. 11 shows a result of the plotted relationship between the volume percentage of so-called coarse particles of 18 $\mu$m or more contained in the thus obtained ground substance and the inclined angle of the grooves of the rotor. Further, FIG. 12 shows a result of the plotted relationship between the volume percentage of so-called excessively finely ground particles of 8 $\mu$m or less contained in the ground substance and the inclined angle of the grooves of the rotor.

Figure 12:
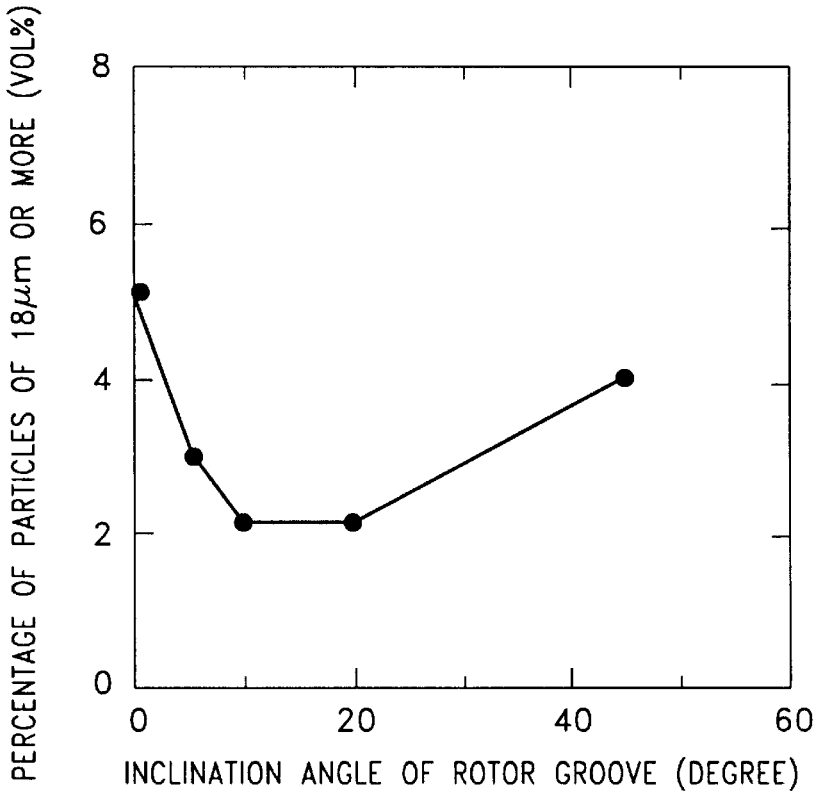
FIG. 12 is a graph showing a result of FIG. 5 and Comparative Example 4.
Figure 13:
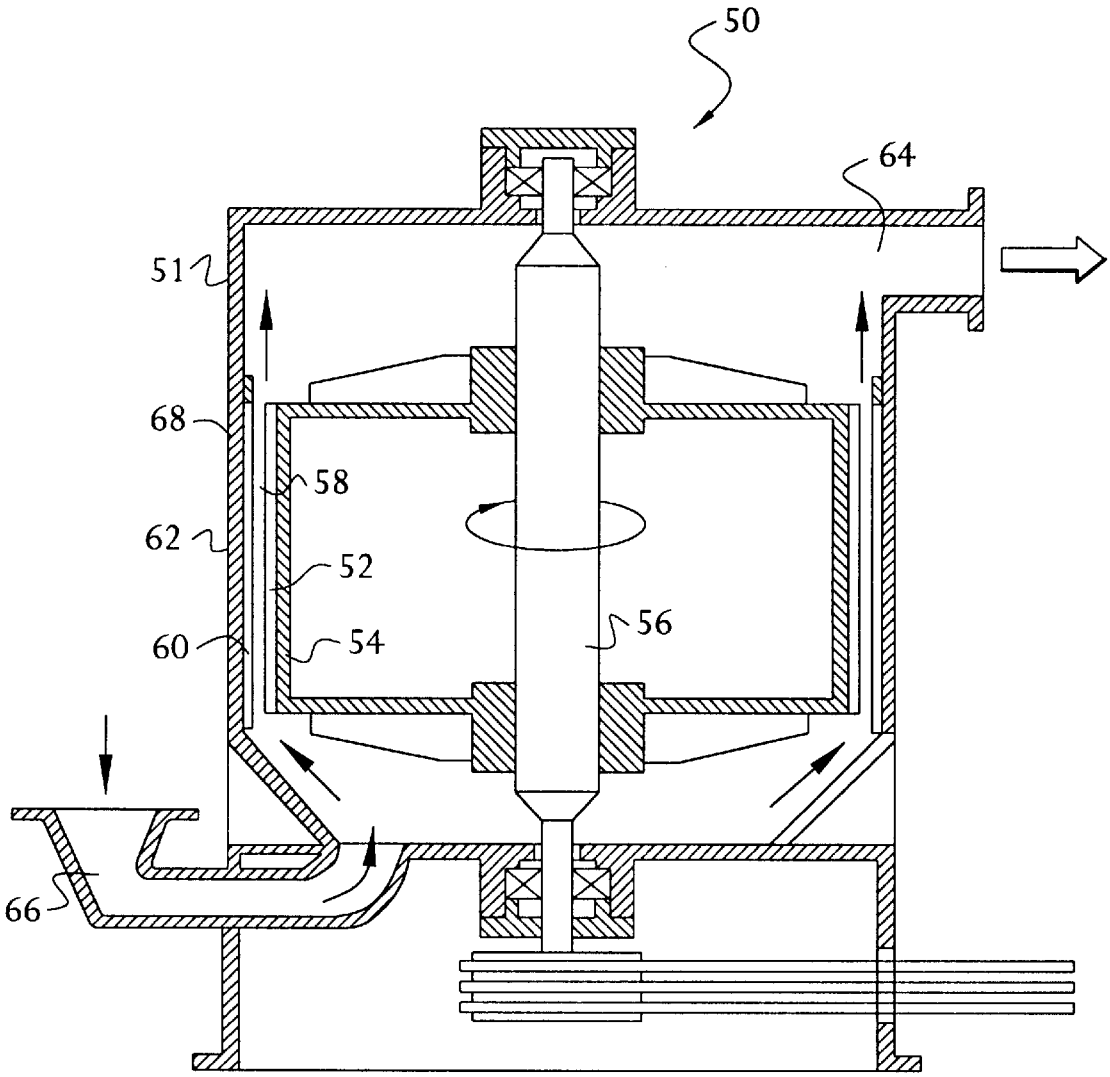
FIG. 13 (PRIOR ART)
FIG. 13 is a schematic cross sectional view showing a conventional rotary mechanical grinding apparatus.
Figure 14A:
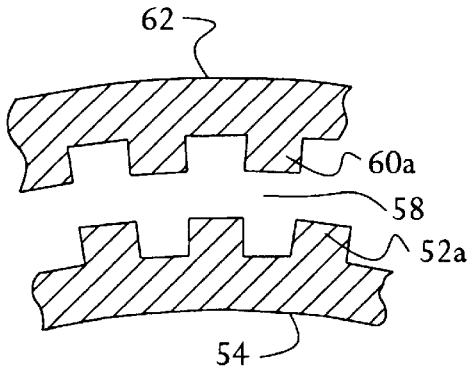
FIG. 14a (PRIOR ART)
FIG. 14*a,* FIG. 14*b.
Figure 14B:
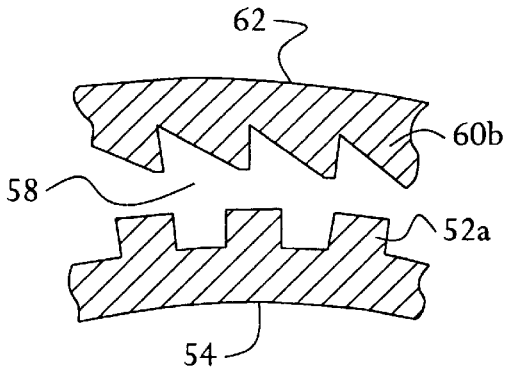
FIG. 14b (PRIOR ART)
* FIG. 14*c* and FIG. 14*d* are partly cross sectional views showing different structures of a rotor and a casing in the conventional grinding apparatus shown in FIG. 13, respectively.
Figure 14C:
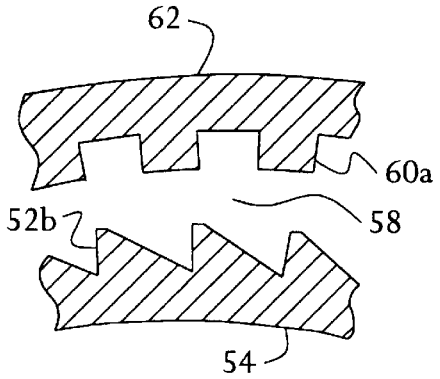
FIG. 14c (PRIOR ART)
Figure 14D:
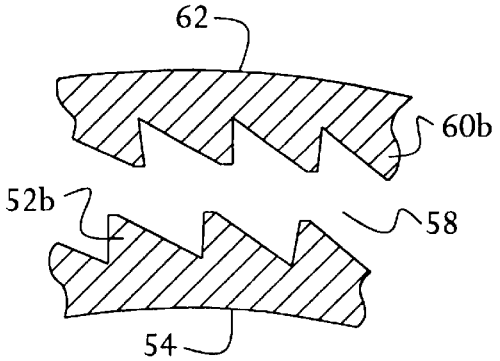
FIG. 14d (PRIOR ART)
Figure 15A:
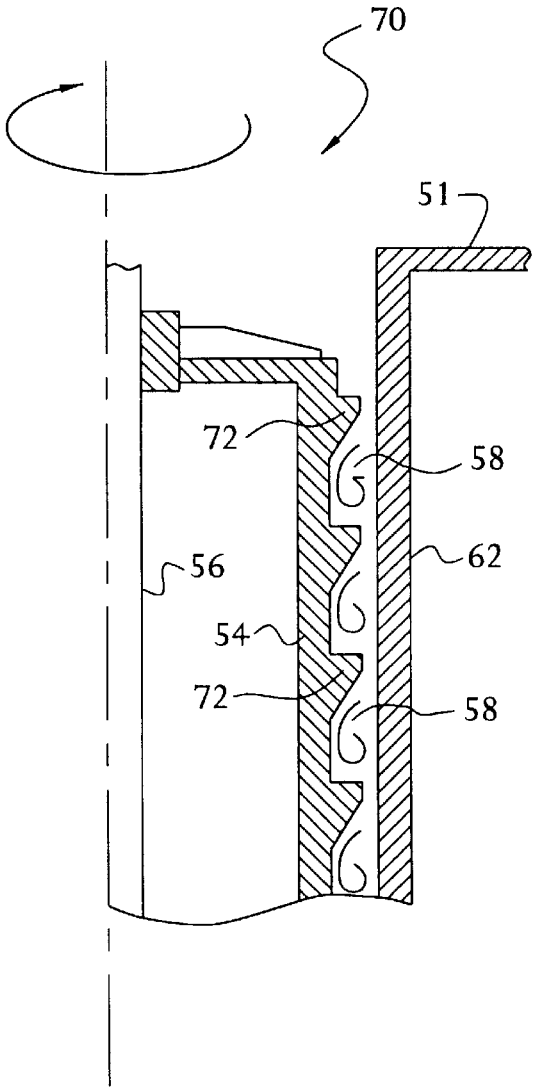
FIG. 15a (PRIOR ART)
FIG. 15*a* and FIG. 15*b* are partly cross sectional views showing further different structures of the rotor and the casing in the conventional grinding apparatus shown in FIG. 13, respectively.
Figure 15B:
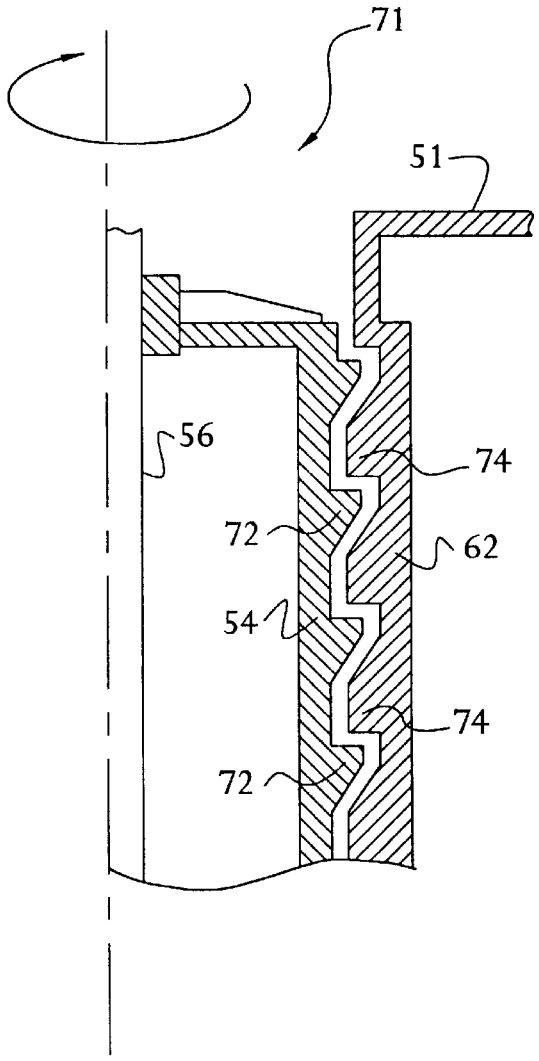
FIG. 15b (PRIOR ART)

As apparent from FIG. 11 and FIG. 12, it is found that when the toner material was ground by the mechanical grinding apparatus of Example 5 of the present invention, a remarkable effect could be obtained as to both of the prevention of over grinding and the prevention of the mixture of coarse particles within the range of the inclined angle of the grooves on the outer circumferential surface of the rotor set from 5° to 45° as compared with the case that the toner material was ground by the mechanical grinding apparatus of Example 4.

(Example 6)

A test was carried out as to a mono-component toner having a maximum particle size of 2 mm as a powder raw material using the mechanical grinding apparatus 30 having the structure shown in FIG. 2.

A plurality of grooves 32 were formed on the inner peripheral surface of the liner 18 in a direction parallel with the direction of the rotary axis of the rotor 16 and the grooves had a pitch of 4 mm, a depth of 2 mm, and in FIG. 5*c* the angle $\alpha$ was set to 45°, the angle $\beta$ was set to 15° and the portion 32*d* was set to 1 mm.

On the other hand, the rotor 16 used was arranged such that it had a diameter of 242 mm and a length of 240 mm, was provided with grooves inclined 10° in a direction for preventing the flow of a grinding subject or in a direction opposite to the above direction and the cross sectional shape of the rotor 16 vertical to the direction in which the grooves were cut in FIG. 5*d* was formed to have the angle $\delta$ of 45°, the angle $\gamma$ of 15°, the portion 3*d* of 1.4 mm and a groove pitch of 4 mm and a groove depth of 2 mm. A gap between the liner 18 and the rotor 16 was set to 2 mm.

A powder raw material was ground by the apparatus 30 with the rotational speed of the rotor 16 set to 10,000 rpm, an air flow rate of a suction blower set to 4 $m^3$/min, a raw material feed rate of 10 kg/hour and an target particle size of 12 $\mu$m. However, a ground substance was collected by a bag filter.

When the particle size of the thus obtained ground substance was measured, it was found that a median particle size was 11.8 $\mu$m, the volume percentage of particles of 18

μm or more was 0.8% and the volume percentage of particles of 7 μm or less was 2.1%.

(Comparative Example 5)

For comparison, a powder material was ground by an apparatus similar to that of Example 6 except that a plurality of grooves 32 and 34 were defined on the inner peripheral surface of the liner 18 and the outer peripheral surface of the rotor 16 in a direction parallel with the direction of the rotary axis of the rotor 16 and the cross sectional shape of the grooves 32 and 34 was set similarly to that of the liner 18 of Example 5 (which is the one described in Japanese Patent Publication 3-15489) under the same conditions as those of Example 6. A resultant ground substance had a median particle size of 12.8 μm, made 1 μm coarser than that of Example 6, the volume percentage of particles of 18 μm or more was 6.4% which was increased to 8 times as much as that of Example 6 and the volume percentage of particles of 7 μm or less was 3.6% or less which was increased to 1.7 times that of Example 6.

(Example 7)

A powder raw material similar to that of Example 6 was ground by an apparatus similar to that of Example 6 under the same conditions except that the cross sectional shape of the grooves of the liner 18 was formed such that the angle α was set to 60° and the angle β was set to 15° in FIG. 5*b*. A resultant ground substance was similar to that of Example 6, had a median particle size smaller than that of Comparative Example 5 and a sharp distribution of particle size.

(Example 8)

A powder raw material similar to that of Example 6 was ground by an apparatus similar to that of Example 6 under the same conditions except that the cross sectional shape of the rotor 16 vertical to the direction in which the grooves 34 of the rotor 16 were cut was formed to have the angle δ of 50° and the angle γ of 15° in FIG. 5*e*. A resultant product was similar to that of Example 6 and had a median particle size smaller than that of Comparative Example 5 and a sharp distribution of particle size.

Although the mechanical grinding apparatus of the present invention is described above in detail, it is needless to say that the present invention is not limited thereto and various improvements and modifications may be made therein within a range not departing from the gist of the present invention.

What is claimed is:

1. A mechanical grinding apparatus for grinding a substance including:

a rotor supported by a rotary shaft and having a plurality of grooves defined on the outer peripheral surface of the rotor;

a liner positioned outside of the rotor so as to form a gap between the liner and the rotor and having a plurality of grooves defined on the inner peripheral surface of the liner; and an air suction device provided at an outlet port of the apparatus and adapted to generate a flow of air in the gap from an inlet port of the apparatus to the outlet port;

wherein said grooves of at least one of said rotor and said liner incline in a direction for tending to prevent the flow of said substance to be ground with respect to a direction of the flow of air parallel with said rotary shaft and wherein said rotor further includes grooves defined on the outer peripheral surface of the rotor which incline in a direction opposite to the flow-preventing direction with respect to the direction parallel with said rotary shaft.

2. The mechanical grinding apparatus according to claim 1, wherein said rotor includes grooves inclined in the flow-preventing direction and grooves inclined in the direction opposite to the flow-preventing direction with respect to the direction parallel with said rotary shaft.

3. The mechanical grinding apparatus according to claim 1, wherein said liner further includes grooves defined on the inner peripheral surface of the liner which incline in the direction opposite to the flow-preventing direction with respect to the direction parallel with said rotary shaft.

4. The mechanical grinding apparatus according to claim 3, wherein said liner includes grooves inclined in the flow-preventing direction and grooves inclined in the direction opposite to the flow-preventing direction with respect to the direction parallel with said rotary shaft.

5. The mechanical grinding apparatus according to claim 1, wherein said grooves of at least one of said rotor and said liner have an inclining angle of from 5° to 90° with respect to the direction parallel with said rotary shaft.

6. The mechanical grinding apparatus according to claim 1, wherein said rotor has grooves inclined in a direction for tending to prevent the flow of said grinding substance and grooves inclined in a direction opposite to said direction with respect to a direction parallel with said rotary shaft and the inclined angle of said grooves is from 5° to 45°.

7. The mechanical grinding apparatus according to claim 1, wherein the cross sectional shape of said grooves of said rotor in a direction perpendicular to the direction of the grooves of said rotor is such that a front side surface is inclined at an angle within the range of 30° in the direction opposite to the rotational direction of said rotor to 30° in the rotational direction of said rotor with respect to a radial direction of said rotor from a center of said rotor and a rear side surface is inclined at an angle within the range 30° to 70° in a direction opposite to the rotational direction of said rotor with respect to a radial direction of rotation of said rotor from a center of said rotor.

8. The mechanical grinding apparatus according to claim 1, wherein said liner has grooves inclined in a direction for tending to prevent the flow of said grinding substance and grooves inclined in a direction opposite to said direction with respect to a direction parallel with the rotary axis of said rotor and the inclined angle of said grooves is from 5° to 45°.

9. The mechanical grinding apparatus according to claim 1, wherein the cross sectional shape of said grooves of said liner in a direction perpendicular to the direction of the grooves of said liner is such that a front side surface is inclined at an angle of the range of 30° to 70° in the rotational direction of said rotor with respect to a central direction of said rotor and a rear side surface is inclined at an angle within the range of 30° in the direction opposite to the rotational direction of said rotor to 30° in the rotation direction of said rotor with respect to a central direction of said rotor.

10. The mechanical grinding apparatus according to claim 1, wherein the rotor and the liner are both cylindrical.

11. The mechanical grinding apparatus according to claim 1, wherein the air suction device is a blower.

12. The mechanical grinding apparatus according to claim 1, wherein said rotor and said liner have grooves inclined in the flow-preventing direction and grooves inclined in the direction opposite to the flow-preventing direction with respect to the direction parallel with said rotary shaft.

13. A mechanical grinding apparatus for grinding a substance including:

a rotor supported by a rotary shaft and having a plurality of grooves defined on the outer peripheral surface of the rotor;

a liner positioned outside of the rotor so as to form a gap between the liner and the rotor and having a plurality of grooves defined on the inner peripheral surface of the liner; and an air suction device provided at an outlet port of the apparatus and adapted to generate a flow of air in the gap from an inlet port of the apparatus to the outlet port;

wherein said grooves of at least one of said rotor and said liner incline in a direction for tending to prevent the flow of said substance to be ground with respect to a direction of the flow of air parallel with said rotary shaft; and wherein said liner further includes grooves defined on the inner peripheral surface of the liner which incline in a direction opposite to the flow-preventing direction with respect to the direction parallel with said rotary shaft.

14. The mechanical grinding apparatus according to claim 13, wherein said liner includes grooves inclined in the flow-preventing direction and grooves inclined in the direction opposite to the flow-preventing direction with respect to the direction parallel with said rotary shaft.

15. The mechanical grinding apparatus according to claim 13, wherein said grooves of at least one of said rotor and said liner have an inclining angle of from 5° to 90° with respect to the direction parallel with said rotary shaft.

16. The mechanical grinding apparatus according to claim 13, wherein said rotor has grooves inclined in a direction for tending to prevent the flow of said grinding substance and grooves inclined in a direction opposite to said direction with respect to a direction parallel with said rotary shaft and the inclined angle of said groove is from 5° to 45°.

17. The mechanical grinding apparatus according to claim 13, wherein the cross sectional shape of said grooves of said rotor in a direction perpendicular to the direction of the grooves of said rotor is such that a front side surface is inclined at an angle within the range of 30° in the direction opposite to the rotational direction of said rotor to 30° in the rotational direction of said rotor with respect to a radial direction of said rotor from a center of said rotor and a rear side surface is inclined at an angle within the range of 30° to 70° in a direction opposite to the rotational direction of said rotor with respect to a radial direction of rotation of said rotor from a center of said rotor.

18. The mechanical grinding apparatus according to claim 13, wherein said liner has grooves inclined in a direction for tending to prevent the flow of said grinding substance and grooves inclined in a direction opposite to said direction with respect to a direction parallel with the rotary axis of said rotor and the inclined angle of said grooves is from 5° to 45°.

19. The mechanical grinding apparatus according to claim 13, wherein the cross sectional shape of said grooves of said liner in a direction perpendicular to the direction of the grooves of said liner is such that a front side surface is inclined at an angle of the range of 30° to 70° in the rotational direction of said rotor with respect to a central direction of said rotor and a rear side surface is inclined at an angle within the range of 30° in the direction opposite to the rotational direction of said rotor to 30° in the rotational direction of said rotor with respect to a central direction of said rotor.

* * * * *

UNITED STATES PATENT AND TRADEMARK OFFICE

CERTIFICATE OF CORRECTION

PATENT NO. : 5,845,855

DATED : December 8, 1998

INVENTOR(S) : Yamada et al.

It is certified that error appears in the above-identified patent and that said Letters Patent are hereby corrected as shown below:

[73] Assignee Nisshin Flour Milling Co., Ltd., Tokyo, Japan
Altenburger Maschinen Jackering GmbH, Hamm ,Germany

Signed and Sealed this

Fourth Day of April, 2000

*Attest:*

*Attesting Officer*

Q. TODD DICKINSON

*Director of Patents and Trademarks*